US007633452B2

(12) United States Patent
Noro et al.

(10) Patent No.: US 7,633,452 B2
(45) Date of Patent: Dec. 15, 2009

(54) HYBRID ANTENNA UNIT WITH A SUITABLY LOCATED BOOSTER CIRCUIT

(75) Inventors: Junichi Noro, Akita (JP); Yuichi Saito, Akita (JP); Toshihiko Inaba, Akita (JP); Kyuichi Sato, Akita (JP)

(73) Assignee: Mitsumi Electric Co., Ltd., Tama-Shi (JP)

( * ) Notice: Subject to any disclaimer, the term of this patent is extended or adjusted under 35 U.S.C. 154(b) by 617 days.

(21) Appl. No.: 11/412,545

(22) Filed: Apr. 27, 2006

(65) Prior Publication Data

US 2006/0290580 A1 Dec. 28, 2006

(30) Foreign Application Priority Data

Jun. 28, 2005 (JP) ..... 2005-187924

(51) Int. Cl.
*H01Q 1/32* (2006.01)

(52) U.S. Cl. ..... 343/713; 343/700 MS; 343/715

(58) Field of Classification Search ..... 343/700 MS, 343/713, 715, 711, 725, 729
See application file for complete search history.

(56) References Cited

U.S. PATENT DOCUMENTS 5,625,365 A * 4/1997 Tom et al. ..... 343/700 MS
6,879,294 B2 * 4/2005 Yuanzhu ..... 343/725
6,930,643 B2 * 8/2005 Byrne et al. ..... 343/702
2003/0197651 A1 * 10/2003 Yuanzhu ..... 343/725
2004/0246196 A1 12/2004 Noro et al.
2005/0093755 A1 * 5/2005 Byrne et al. ..... 343/713

FOREIGN PATENT DOCUMENTS

EP 0 747 993 A2 12/1996
EP 0 862 239 B1 2/2005
JP 10-107542 A 4/1998

* cited by examiner

*Primary Examiner*—HoangAnh T Le
(74) *Attorney, Agent, or Firm*—Frishauf, Holtz, Goodman & Chick, P.C.

(57) ABSTRACT

An antenna element including first and second pole antenna elements is inserted in an antenna case. In the antenna case, a main circuit board having first and second surfaces opposite to each other is mounted. Mounted on the first surface of the main circuit board, a first antenna unit receives a first radio wave from a first kind of satellites. Mounted on the first surface of the main circuit board, a second antenna unit receives a second radio wave from a second kind of satellites. On the second surface of the main circuit board, a booster circuit for the first pole antenna element is mounted.

7 Claims, 5 Drawing Sheets

HYBRID ANTENNA UNIT WITH A SUITABLY LOCATED BOOSTER CIRCUIT

This application claims priority to prior Japanese patent application JP 2005-187924, the disclosure of which is incorporated herein by reference.

BACKGROUND OF THE INVENTION

This invention relates to a hybrid or compound antenna unit and, in particular, to a hybrid antenna unit for mounting a plurality of different antennas therein.

In the manner which is known in the art, recently, various different antennas are mounted in a vehicle such as an automobile. For example, there are, as such antennas, a GPS (Global Positioning System) antenna, an SDARS (Satellite Digital Audio Radio Service) antenna, a radio telephone antenna, an AM/FM radio antenna, or the like.

The GPS (Global Positioning System) is a satellite positioning system using artificial satellites which are called GPS satellites. The GPS is a system which receives radio waves (GPS signals) from four GPS satellites among twenty-four GPS satellites orbiting the Earth, measures, on the basis of the received waves, a position relationship and a time error between a mobile object and the four GPS satellites, and accurately calculates, on the basis of a principal of triangulation techniques, a position and/or a height of the mobile object on a map.

In recent years, the GPS is used in a car navigation system for detecting a position of a running automobile or the like and becomes widespread. In the car navigation system, a car navigation apparatus comprises a GPS antenna for receiving the GPS signals, a processing unit for processing the GPS signal received by the GPS antenna to detect a current position of the vehicle, a display unit for displaying, on the map, the position detected by the processing unit, and so on.

On the other hand, a rod antenna (a pole antenna) is known as a 3-waveband antenna which is capable of receiving three radio waves of portable radiophone bands, FM radio bands, and AM bands. In addition, a multi-frequency antenna capable of receiving four radio waves of the portable radiophone bands, the FM radio bands, the AM radio bands, and GPS radio bands is proposed in EP0862239 (B1) which will be called a patent document 1 hereinafter. The multi-frequency antenna disclosed in the patent document 1 comprises an antenna element, a base, a circuit board affixed on the base in a standing condition, and a GPS antenna. A GPS antenna storage part for mounting the GPS antenna is integrally formed in the base so that it is orthogonal to the circuit board. The antenna element is inclined from a vertical position on the base. With this structure, the antenna element does not have a detrimental affect on the GPS antenna although the GPS radio waves arrive at a low angle of elevation.

In addition, a dual antenna is disclosed in U.S. Pat. No. 6,879,294 issued to Dou Yuanzhu that will be called a patent document 2 hereinafter. The dual antenna disclosed in the patent document 2 is unitized by installing in parallel a patch antenna capable of transmitting and receiving a circularly polarized electromagnetic wave to and from the GPS satellite or the like and a rod-shaped antenna for transmitting and receiving a linearly polarized electromagnetic wave for use in mobile telephony or the like. In the dual antenna disclosed in the patent document 2, a direction of a power feed patch relative to the rod-shaped antenna is set so that a short axis thereof substantially orthogonally crosses a plane containing an intersection between the short axis and a long axis of the power feed patch of the patch antenna and an axis of the rod-shaped antenna. With this structure, it is possible to make less susceptible to the adverse effect of the electromagnetic wave radiated from the rod-shaped antenna on the patch antenna adjoining the rod-shaped antenna.

Furthermore, another antenna unit suitable to insert in a car body is proposed in Japanese Unexamined Patent Publication Tokkai No. Hei 10-107542, namely, JP 10-107542 A1 which will be called a patent document 3 hereinafter. The antenna unit disclosed in the patent document 3 can receive both of a radio wave signal radiated from an artificial satellite and a terrestrial wave signal radiated from a terrestrial antenna. In the antenna unit disclosed in the patent document 3, a planar antenna is mounted on a main surface of a board provided in a case. The planar antenna has an upper side directed upward. An antenna element acting as a helical antenna has a base end displaced from the planar antenna toward a side and has a tip provided with a tilt of about 30 degrees from a perpendicular line in the displaced direction.

In addition, a three-wave receiving antenna apparatus is proposed in EP0747993 (A1) which will be called a patent document 4 hereinafter. The three-wave receiving antenna apparatus disclosed in the patent document 4 is an integrated antenna apparatus comprising an AM/FM wave receiving antenna capable of receiving an AM wave and an FM wave and a GPS wave receiving antenna capable of a GPS wave transmitted via a GPS satellite. The integrated antenna apparatus is suitable for, e.g., a vehicle antenna apparatus.

On the other hand, the SDARS (Satellite Digital Audio Radio Service) is a radio service according to a digital radio broadcasting using artificial satellites (which will called "SDARS satellites" hereinafter) in the United States of America. That is, in recent years, a digital radio receiver, which receives the satellite wave from the SDARS satellites or the terrestrial wave so as to listen to the digital radio broadcasting, has been developed and is put to practical use in the United States of America. Specifically, two broadcasting stations called XM and Sirius provide radio programs on 250 or more channels in total. The digital radio receiver is generally mounted on a mobile object such as an automobile and is adapted to receive a radio wave having a frequency of about 2.3 gigahertz (GHz) as a received wave to listen to the digital radio broadcasting. In other words, the digital radio receiver is a radio receiver capable of listening to mobile broadcasting. Inasmuch as the received wave has the frequency of about 2.3 GHz, a reception wavelength (resonance frequency) A thereof is equal to about 128.3 mm. It is noted here that the terrestrial wave is a radio wave obtained by receiving the satellite wave at a ground station, slightly shifting the frequency of the satellite wave, and retransmitting the linear polarized wave. Thus, the terrestrial wave is the linear polarized wave exhibiting linear polarization while the satellite wave is a circular polarized wave exhibiting circular polarization.

An XM satellite radio antenna apparatus normally serves to receive circular polarized radio waves from two stationary satellites and, in an insensitive zone of the circular polarized waves, receives a radio wave by using a terrestrial linear polarization portion of the radio antenna apparatus. On the other hand, a Sirius satellite radio antenna apparatus normally serves to receive circular polarized radio waves from three orbiting satellites (synchronous type) and, in the insensitive zone, receives a radio wave by a terrestrial linear polarization portion of the radio antenna apparatus.

As described above, the radio wave having the frequency of about 2.3 GHz is used in the digital radio broadcasting. Therefore, an antenna for receiving the radio wave must be located outside as known in the art. If the digital radio receiver is mounted in the mobile object such as the automobile, the antenna unit is must be attached to a roof of the mobile object (car body).

In the manner which is described above, various types of hybrid antenna units for mounting a plurality of antennas of different types therein have been known in the art. In addition, those skilled in the art might easily come with ideas using, as one of the hybrid antenna units, one mounting a GPS antenna and a SDASR antenna on a main surface of a circuit board as well as the above-mentioned 3-waveband antenna capable of receiving the three radio waves of the portable radiophone bands, the FM radio bands, and the AM bands thereon. Under the circumstances, if a booster circuit for the AM/FM radio bands is mounted on the main surface of the circuit board, circuit parts constituting the booster circuit serves as an impediment or obstruction (blind) with respect to the GPS antenna and/or the SDARS antenna.

Accordingly, it is necessary for the last-mentioned hybrid antenna unit to mount the booster circuit on the circuit board at a suitable position thereof.

SUMMARY OF THE INVENTION

It is therefore an object of the present invention to provide a hybrid antenna unit in which a booster circuit is mounted on a circuit board without serving as an obstruction with respect to an antenna for receiving a radio wave from an artificial satellite.

Other objects of this invention will become clear as the description proceeds.

According to a first aspect of this invention, a hybrid antenna unit comprises an antenna element, an antenna case in which the antenna element is inserted, a main circuit board, mounted in the antenna case, having first and second surfaces opposite to each other, an antenna unit, mounted on the first surface of the main circuit board, for receiving a radio wave from artificial satellites, and a booster circuit, mounted on the second surface of the main circuit board, for use in the antenna element.

In the afore-mentioned hybrid antenna unit according to the first aspect of this invention, the antenna element may include a first pole antenna element and a second pole antenna element. In this event, the booster circuit may be a booster circuit for use in the first pole antenna element. The first pole antenna element may be for receiving a radio wave of AM/FM radio bands and the second pole antenna element may be for transmitting and receiving a radio wave for mobile telephone. The antenna case may includes a bottom case in which the main circuit board is mounted. In this event, the main circuit board is arranged to the bottom case with the second surface and the bottom case opposed to each other. The antenna unit may comprise a first antenna unit for receiving a first radio wave form a first kind of artificial satellites and a second antenna unit for receiving a second radio wave from a second kind of artificial satellites. Under the circumstances, the first antenna unit may comprise a first auxiliary circuit board having a first main surface and a first rear surface which are opposite to each other, a first planar antenna element, mounted on the first main surface of the first auxiliary circuit board, for receiving the first radio wave from the first kind of artificial satellites, a first low noise amplifier circuit, mounted on the first rear surface of the first auxiliary circuit board, for amplifying a first received signal received by the first planar antenna element, and a first shielding case for shielding the first low noise amplifier circuit. The second antenna unit may comprise a second auxiliary circuit board having a second main surface and a second rear surface which are opposite to each other, a second planar antenna element, mounted on the second main surface of the second auxiliary circuit board, for receiving the second radio wave from the second kind of artificial satellites, a second low noise amplifier circuit, mounted on the second main surface of the second auxiliary circuit board, for amplifying a second received signal received by the second planar antenna element, and a second shielding case for shielding the second low noise amplifier circuit. The first antenna unit may comprise a GPS antenna for receiving the first radio wave from GPS satellites as the first kind of artificial satellites and the second antenna unit may comprise a SDARS antenna for receiving the second radio wave from SDARS satellites as the second kind of artificial satellites.

According to a second aspect of this invention, a hybrid antenna unit comprises a pole antenna element, a circuit board for mounting a booster circuit for the pole antenna element thereon, an antenna case in which the pole antenna element is inserted, and an antenna unit. The antenna unit comprises an antenna element for receiving a radio wave from artificial satellites, a low noise amplifier circuit board on which a low noise amplifier circuit for amplifying a received signal received by the antenna element is mounted, and a shielding case for shielding the low noise amplifier circuit on the low noise amplifier circuit board. The circuit board is mounted in the antenna case. The circuit board has first and second surface opposite to each other. The antenna unit is mounted on the first surface of the circuit board. The booster circuit is mounted on the second surface of the circuit board without mounting circuit parts constructing the booster circuit on the first surface of the circuit board.

In the afore-mentioned hybrid antenna unit according to the second aspect of this invention, the antenna unit may comprise first and second antenna units. In this event, the first antenna unit comprises a first antenna element for receiving a first radio wave from a first kind of artificial satellites, a first low noise amplifier circuit board on which a first low noise amplifier circuit for amplifying a first received signal received by the first antenna element is mounted, and a first shielding case for shielding the first low noise amplifier circuit on the first low noise amplifier circuit board. The second antenna unit comprises a second antenna element for receiving a second radio wave from a second kind of artificial satellites, a second low noise amplifier circuit board on which a second low noise amplifier circuit for amplifying a second received signal received by the second antenna element is mounted, and a second shielding case for shielding the second low noise amplifier circuit on the second low noise amplifier circuit board. The antenna case may include a bottom case in which the circuit board is mounted. In this event, the circuit board is mounted in the bottom case with the second surface and the bottom case opposed to each other.

DESCRIPTION OF THE PREFERRED EMBODIMENT

Figure 1:
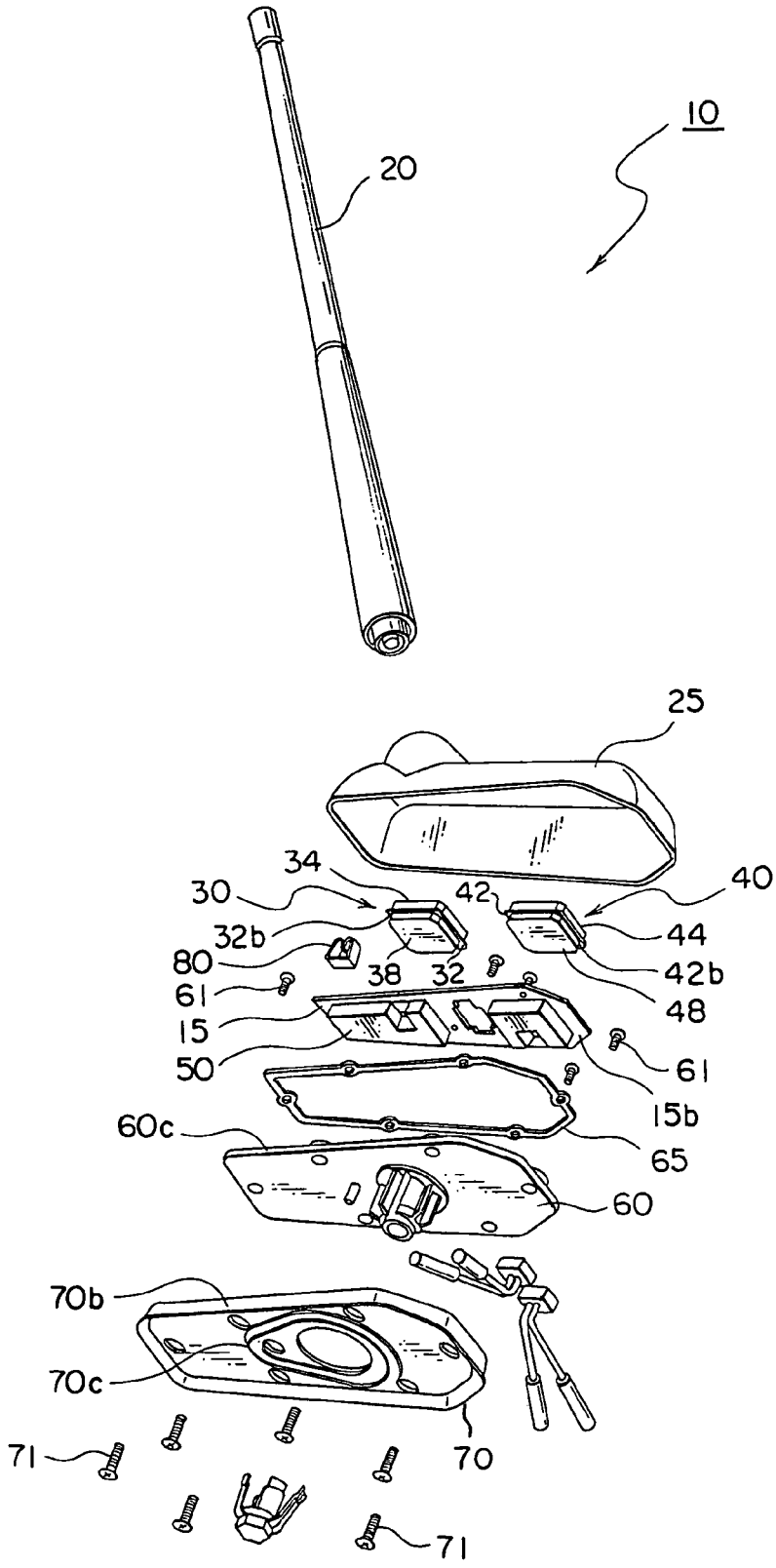
FIG. 1 is an exploded perspective view of a hybrid antenna unit according to an embodiment of this invention seen obliquely from a lower surface side.
Figure 2:
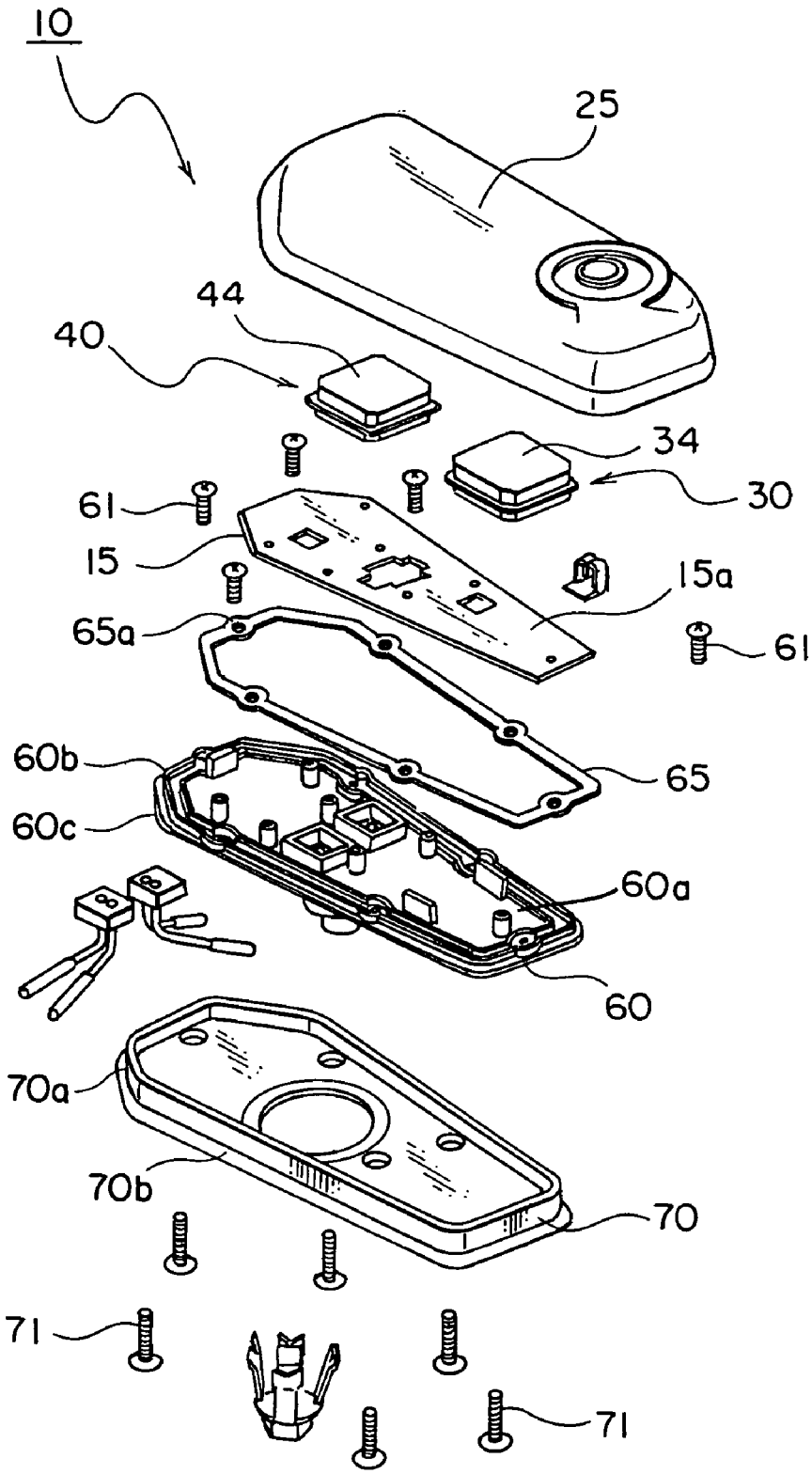
FIG. 2 is an exploded perspective view of the hybrid antenna unit illustrated in FIG. 1 with an antenna element omitted seen obliquely from an upper surface side.
Figure 3:
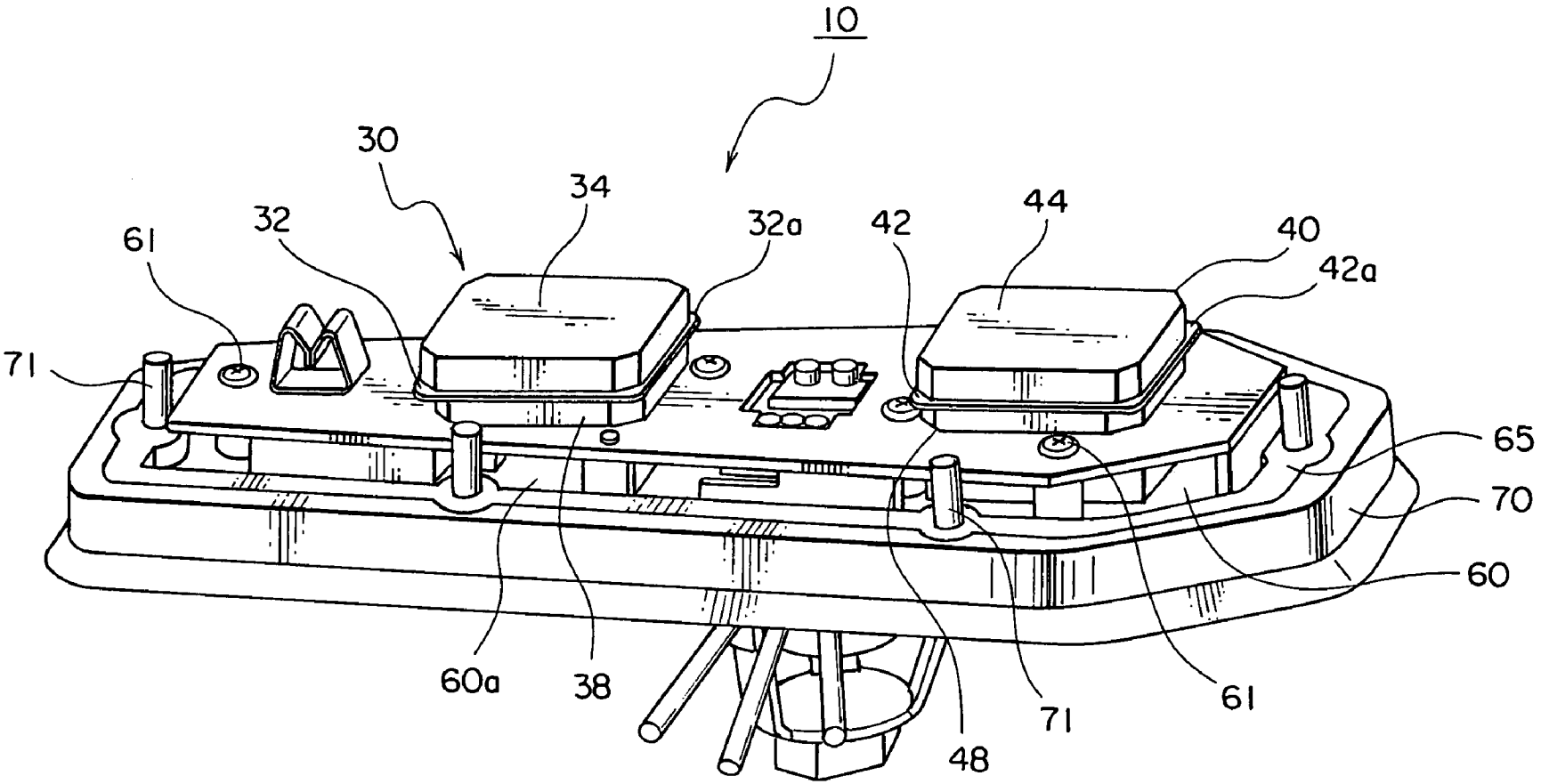
FIG. 3 is a perspective view of the hybrid antenna unit illustrated in FIG. 1 with the antenna element and an antenna case omitted.

Referring to FIGS. 1 through 3, the description will proceed to a hybrid antenna unit 10 according to an embodiment of the present invention. FIG. 1 is an exploded perspective view of the hybrid antenna unit 10 seen obliquely from a lower surface side. FIG. 2 is an exploded perspective view of the hybrid antenna unit 10 with an antenna element (which will later be described) omitted seen obliquely from an upper surface side. FIG. 3 is a perspective view of the hybrid antenna unit 10 with the antenna element and an antenna case (which will later be described) omitted.

The illustrated hybrid antenna unit 10 comprises the antenna element depicted at 20 and an antenna case 25 in which the antenna element 20 is inserted. The antenna element 20 includes a first pole antenna element (which will later be described) and a second pole antenna element (which will later be described). In the antenna case 25, a main circuit board 15 is mounted. On the main circuit board 15, a AM/FM radio booster circuit 50 is mounted in the manner which will later be described. The main circuit board 15 has a first surface (an upper surface) 15*a* and a second surface (a lower surface) 15*b* which are opposite to each other. The antenna element 20 is inclined from a vertical position.

On the second surface (the lower surface) 15*b* of the main circuit board 15, the booster circuit 50 for the first pole antenna element in the antenna element is mounted. By disposing circuit parts constituting the booster circuit 50 on the second surface 15*b*, the circuit parts are never disposed on the first surface 15*a* and are collectively mounted on the second surface 15*b*. On the first surface (the upper surface) 15*a* of the main circuit board 15, a conductive member 80 is mounted. The conductive member 80 is for connecting a first antenna unit 30 and a second antenna unit 40 with the booster circuit 50 mounted on the second surface 15*b*. The first antenna unit 30 is for receiving a first radio wave from a first kind of artificial satellites while the second antenna unit 40 is for receiving a second radio wave from a second kind of artificial satellites. In the example being illustrated, the first antenna unit 30 comprises a GPS antenna for receiving the first radio wave from GPS satellites as the first kind of the artificial satellites while the second antenna unit 40 comprises an SDARS antenna for receiving the second radio wave from SDARS satellites as the second kind of the artificial satellites.

Figure 4A:
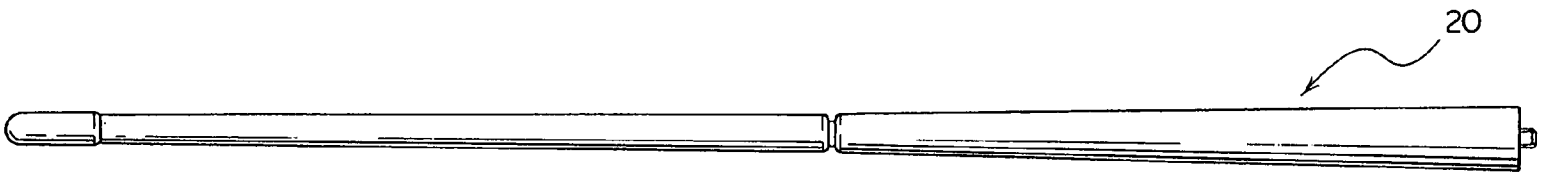
FIG. 4A is a side view showing an outer appearance of the antenna element for use in the hybrid antenna unit illustrated in FIG. 1.
Figure 4B:
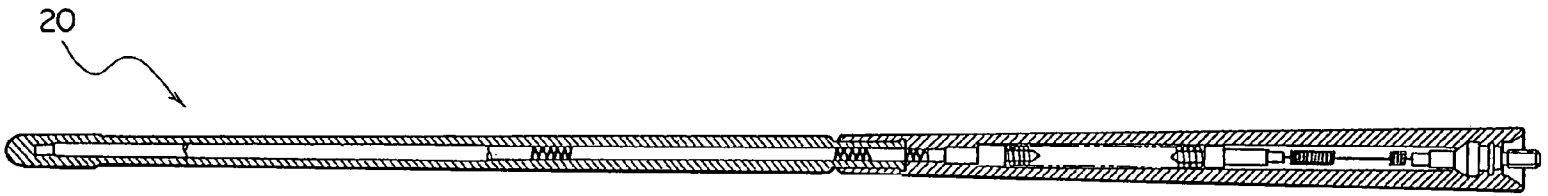
FIG. 4B is a cross-sectional view of the antenna element illustrated in FIG. 4A.
Figure 4C:
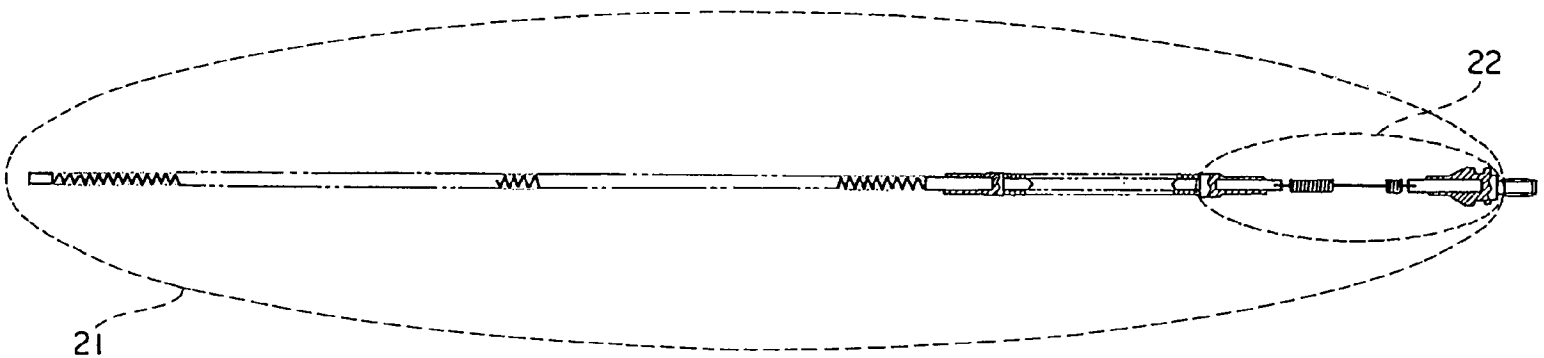
FIG. 4C is a view showing the antenna element illustrated in FIG. 4A with a body thereof omitted.

FIGS. 4A, 4B, and 4C show the antenna element 20 for use in the hybrid antenna unit 10. FIG. 4A is a side view showing an outer appearance of the antenna element. FIG. 4B is a cross-sectional view of the antenna element 20. FIG. 4C is a view showing the antenna element 20 with a body thereof omitted.

As shown in FIG. 4C, the antenna element 20 comprises the first pole antenna element depicted at 21 and the second pole antenna element depicted at 22. The first pole antenna element 21 extends from a tip of the antenna element 20 to a base end part thereof. The first pole antenna element 21 is for receiving a radio wave of AM/FM radio bands. The second pole antenna element 21 is a portion between the base end part of the antenna element 20 and a predetermined position apart from the base end part by a predetermined distance. The second pole antenna element 21 is for receiving a radio wave for a mobile telephone or a car phone.

Figure 5:
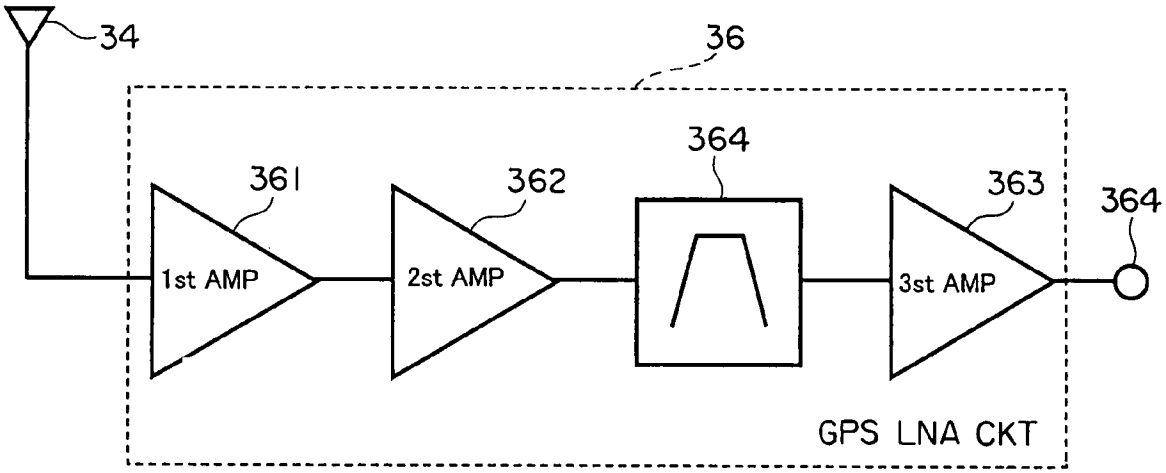
FIG. 5 is a block diagram of a first LNA (low noise amplifier) circuit for use in the hybrid antenna unit illustrated in FIG. 1.

Referring to FIG. 5 in addition to FIGS. 1-3, the first antenna unit 30 comprises a first auxiliary circuit board 32 having a main surface 32*a* and a rear surface 32*b* opposite to each other, a first planar antenna element 34 mounted on the main surface 32*a* of the first auxiliary circuit board 32, a first LNA (low noise amplifier) circuit 36 mounted on the rear surface 32*b* of the first auxiliary circuit 32, and a first shielding case 38 for shielding the first LNA circuit 36. The first planar antenna element 34 is for receiving the first radio wave from the first kind of artificial satellites (GPS satellites). The first LAN circuit 36 is for amplifying a first received signal received by the planar antenna element 34. The first LNA circuit 36 is also called a GPS LAN circuit.

As shown in FIG. 5, the first LAN circuit (GPS LAN circuit) 36 comprises a first GPS amplifier 361, a second GPS amplifier 362, a third GPS amplifier 363, and a GPS band-pass filter 364. The first GPS amplifier 361 has an input terminal connected to the first planar antenna element 34. The first GPS amplifier 361 has an output terminal connected to an input terminal of the second GPS amplifier 362. The second GPS amplifier 362 has an output terminal connected to an input terminal of the GPS band-bass filter 364. The GPS band-pass filter 364 has an output terminal connected to an input terminal of the third GPS amplifier 363. The third GPS amplifier 363 has an output terminal connected to a first LNA output terminal 364 of the first LAN circuit 36.

The first GPS amplifier 361 is supplied with, as a GPS received signal, the first received signal received by the first planar antenna element 34. The first GPS amplifier 361 amplifies the GPS received signal to produce a first GPS amplified signal which is supplied to the second GPS amplifier 362. The second GPS amplifier 362 amplifies the first GPS amplified signal to produce a second GPS amplified signal which is supplied to the GPS band-pass filter 364. The GPS band-pass filter 364 has a GPS pass band of about 1.5 GHz. The GPS band-pass filter 364 extracts the GPS pass band from the second GPS amplified signal to produce a GPS band-passed signal which is supplied to the third GPS amplifier 363. The third GPS amplifier 353 amplifies the GPS band-passed signal to produce a third GPS amplified signal. The third GPS amplified signal is produced by the first LNA output terminal 364 as a first low noise amplified output signal.

Figure 6:
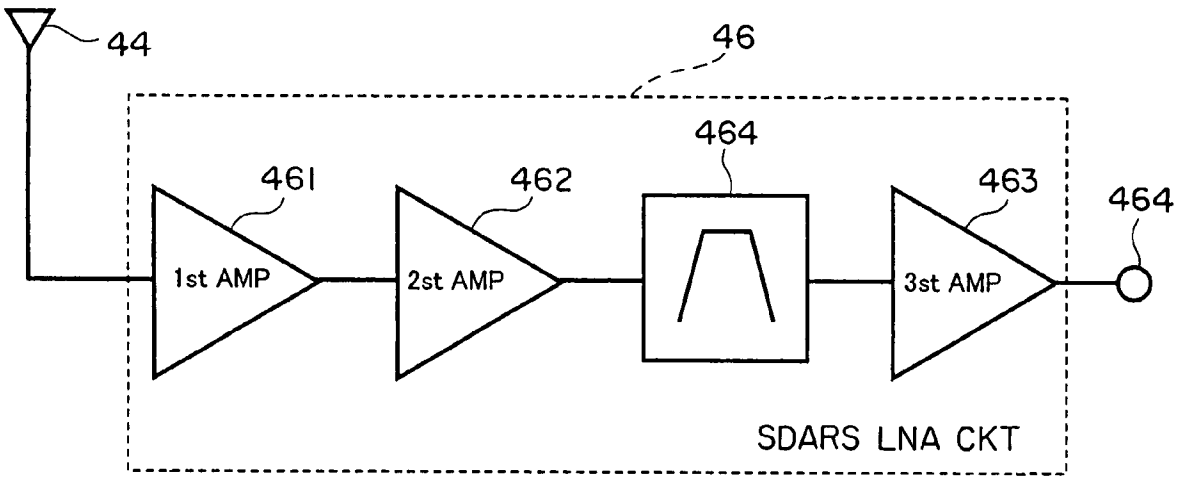
FIG. 6 is a block diagram of a second LNA (low noise amplifier) circuit for use in the hybrid antenna unit illustrated in FIG. 1.

Referring to FIG. 6 in addition to FIGS. 1-3, the second antenna unit 40 comprises a second auxiliary circuit board 42 having a main surface 42*a* and a rear surface 42*b* opposite to each other, a second planar antenna element 44 mounted on the main surface 42*a* of the second auxiliary circuit board 42, a second LNA (low noise amplifier) circuit 46 mounted on the rear surface 42*b* of the second auxiliary circuit 42, and a second shielding case 48 for shielding the second LNA circuit 46. The second planar antenna element 44 is for receiving a second received wave from the second kind of artificial satellites (the SDARS satellites). The second LNA circuit 46 is a circuit for amplifying the second received signal received by the second planar antenna element 44. The second LNA circuit 46 is also called an SDARS LAN circuit.

As shown in FIG. 6, the second LAN circuit (SDARS LAN circuit) 46 comprises a first SDARS amplifier 461, a second SDARS amplifier 462, a third SDARS amplifier 463, and a SDARS band-pass filter 464. The first SDARS amplifier 461 has an input terminal connected to the second planar antenna element 44. The first SDARS amplifier 461 has an output terminal connected to an input terminal of the second SDARS amplifier 462. The second SDARS amplifier 462 has an output terminal connected to an input terminal of the SDARS band-bass filter 464. The SDARS band-pass filter 464 has an output terminal connected to an input terminal of the third SDARS amplifier 463. The third SDARS amplifier 463 has an output terminal connected to a second LNA output terminal 464 of the second LAN circuit 46.

The first SDARS amplifier 461 is supplied with, as an SDARS received signal, the second received signal received by the second planar antenna element 44. The first SDARS amplifier 461 amplifies the SDARS received signal to produce a first SDARS amplified signal which is supplied to the second SDARS amplifier 462. The second SDARS amplifier 462 amplifies the first SDARS amplified signal to produce a second SDARS amplified signal which is supplied to the SDARS band-pass filter 464. The SDARS band-pass filter 464 has an SDARS pass band of about 2.3 GHz. The SDARS band-pass filter 464 extracts the SDARS pass band from the second SDARS amplified signal to produce an SDARS band-passed signal which is supplied to the third SDARS amplifier 463. The third SDARS amplifier 463 amplifies the SDARS band-passed signal to produce a third SDARS amplified signal. The third SDARS amplified signal is produced by the second LNA output terminal 464 as a second low noise amplified output signal.

As illustrated in FIGS. 2 and 3, the main circuit board 15 is attached to a die-cast base 60 by using screws 61 apart from a main surface 60*a* of the die-cast base 60 by a predetermined distance. The die-cast base 60 serves as a bottom case in which the main circuit board 15 is mounted. The main circuit board 15 is tightened by the screws 61 with the second surface 15*b* opposed to the main surface 60*a* of the die-cast base 60. Between the main surface 60*a* of the die-cast base 60 and the main circuit board 15, the booster circuit 50 is disposed. On the first surface 15*a* of the main circuit board 15, the first antenna unit 30 and the second antenna unit 40 are mounted.

The main surface 60*a* of the die-cast base 60 has an outer edge on which a ring-shaped groove 60*b* is formed. A waterproof packing or gasket 65 is fitted in the ring-shaped groove 60b. The antenna case 25 has an inner wall on which a ring-shaped protrusion (not shown) is formed. The ring-shaped protrusion projects toward the die-cast base 60 from a portion corresponding to a position of the waterproof packing 65.

The die-cast base 60 and the antenna case 25 are attached and fixed to each other by inserting screws 71 from a base pad 70 side to the die-cast base 60, by passing the screws 71 through holes 65*a* bored in the waterproof packing 65, and by tightening the screws 71 in bosses (not shown) formed in the inner wall of the antenna case 25.

When the die-cast base 60 and the antenna case 25 are tightened to each other by the screws 71, the above-mentioned ring-shaped protrusion elastically comes into contact with the waterproof packing 65 and the screws 71 pass through the holes 65*a* of the waterproof packing 65. In this event, the above-mentioned ring-shaped protrusion elastically comes into contact with outer edges of the holes 65 and it results in rendering the hybrid antenna unit 10 waterproof.

The base pad 70 is made of elastic resin and has a wall portion 70*a*. The base pad 70 is mounted to the die-cast base 60 with the wall portion 70*a* fitted in an outer edge portion 60*c* of the die-cast base 60. The base pad 70 further has a skirt portion 70*b* at an outer edge thereof and a ring-shaped pad 70*c* in a lower surface thereof. When the hybrid antenna unit 10 is mounted on a car body, the skirt portion 70*b* and the ring-shaped pad 70*c* are kept in absolute with the car body to seal between the car body and the base pad 70. That is, the skirt portion 70*b* has a waterproof function without impairing an outer appearance of the hybrid antenna unit 10. The ring-shaped pad 70*c* has a waterproof function.

Inasmuch as the booster circuit 50 for the first pole antenna element 21 is not mounted on the first surface (the upper surface) 15*a* of the main circuit board 15 but is mounted on the second surface (the lower surface) 15*b* of the main circuit board 15 without mounting the circuit parts constructing the booster circuit 50 on the first surface 15*a* of the main circuit board 15, it is possible to prevent the circuit parts constructing the booster circuit 50 from serving an obstruction (blind) with respect to the first antenna unit (the GPS antenna) 30 and the second antenna unit (the SDARS antenna) 40. In addition, inasmuch as the circuit parts constructing the booster circuit 50 is collectively mounted on the second surface 15*b* of the main circuit board 15, it is possible to dispose the first and the second antenna units 30 and 40 on the first surface 15*a* of the main circuit board 15, it is possible to provide a compact antenna unit and it results in space savings within the antenna unit.

While this invention has thus far been described in conjunction with the preferred embodiment thereof, it will now be readily possible for those skilled in the art to put this invention into various other manners.

What is claimed is:

1. A hybrid antenna unit comprising:

an antenna element;

an antenna case in which said antenna element is inserted;

a main circuit board mounted in said antenna case, said main circuit board having first and second surfaces opposite to each other;

an antenna unit, mounted on the first surface of said main circuit board, for receiving a radio wave from artificial satellites; and a booster circuit, mounted on the second surface of said main circuit board, for use in said antenna element;

wherein said antenna unit comprises:

a first antenna unit for receiving a first radio wave from a first kind of artificial satellites; and a second antenna unit for receiving a second radio wave from a second kind of artificial satellites;

wherein said first antenna unit comprises:

a first auxiliary circuit board having a first main surface and a first rear surface which are opposite to each other;

a first planar antenna element, mounted on the first main surface of said first auxiliary circuit board, for receiving the first radio wave from said first kind of artificial satellites;

a first low noise amplifier circuit, mounted on the first rear surface of said first auxiliary circuit board, for amplifying a first received signal received by said first planar antenna element; and a first shielding case for shielding said first low noise amplifier circuit; and wherein said second antenna unit comprises:

a second auxiliary circuit board having a second main surface and a second rear surface which are opposite to each other;

a second planar antenna element, mounted on the second main surface of said second auxiliary circuit board, for receiving the second radio wave from said second kind of artificial satellites;

a second low noise amplifier circuit, mounted on the second main surface of said second auxiliary circuit board, for amplifying a second received signal received by said second planar antenna element; and a second shielding case for shielding said second low noise amplifier circuit.

2. The hybrid antenna unit as claimed in claim 1, wherein said antenna element includes a first pole antenna element and a second pole antenna element, said booster circuit being a booster circuit for use in said first pole antenna element.

3. The hybrid antenna unit as claimed in claim 2, wherein said first pole antenna element is for receiving a radio wave of AM/FM radio bands, and said second pole antenna element is for transmitting and receiving a radio wave for a mobile telephone.

4. The hybrid antenna unit as claimed in claim 1, wherein said antenna case includes a bottom case in which said main circuit board is mounted, said main circuit board being arranged to said bottom case with said second surface and said bottom case opposed to each other.

5. The hybrid antenna unit as claimed in claim 1, wherein said first antenna unit comprises a GPS (Global Positioning System) antenna for receiving the first radio wave from GPS (Global Positioning System) satellites as the first kind of artificial satellites and wherein said second antenna unit comprises a SDARS (Satellite Digital Audio Radio Service) antenna for receiving the second radio wave from SDARS (Satellite Digital Audio Radio Service) satellites as the second kind of artificial satellites.

6. A hybrid antenna unit comprising:

a pole antenna element;

a circuit board for mounting a booster circuit for said pole antenna element thereon;

an antenna case in which said pole antenna element is inserted; and an antenna unit comprising an antenna element for receiving a radio wave from artificial satellites, a low noise amplifier circuit board on which a low noise amplifier circuit for amplifying a received signal received by said antenna element is mounted, and a shielding case for shielding said low noise amplifier circuit on said low noise amplifier circuit board;

wherein said circuit board is mounted in said antenna case, said circuit board has first and second surfaces opposite to each other, said antenna unit is mounted on the first surface of said circuit board, and said booster circuit is mounted on the second surface of said circuit board without mounting circuit parts forming said booster circuit on the first surface of said circuit board;

wherein said antenna unit comprises:

a first antenna unit comprising a first antenna element for receiving a first radio wave from a first kind of artificial satellites, a first low noise amplifier circuit board on which a first low noise amplifier circuit for amplifying a first received signal received by said first antenna element is mounted, and a first shielding case for shielding said first low noise amplifier circuit on said first low noise amplifier circuit board; and a second antenna unit comprising a second antenna element for receiving a second radio wave from a second kind of artificial satellites, a second low noise amplifier circuit board on which a second low noise amplifier circuit for amplifying a second received signal received by said second antenna element is mounted, and a second shielding case for shielding said second low noise amplifier circuit on said second low noise amplifier circuit board.

7. The hybrid antenna unit as claimed in claim 6, wherein said antenna case includes a bottom case in which said circuit board is mounted, said circuit board being mounted in said bottom case with said second surface and said bottom case opposed to each other.

* * * * *